US008005395B2

(12) United States Patent
Lewis et al.

(10) Patent No.: US 8,005,395 B2
(45) Date of Patent: Aug. 23, 2011

(54) UNIVERSAL CARTRIDGE SEAL AND METHOD FOR FIXING THE SEAL TO A CARTRIDGE

(75) Inventors: Lawrence Dale Lewis, Sanford, NC (US); Glenn L. Szabo, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 658 days.

(21) Appl. No.: 12/079,090

(22) Filed: Mar. 25, 2008

(65) Prior Publication Data

US 2009/0245853 A1 Oct. 1, 2009

(51) Int. Cl.
*G03G 15/00* (2006.01)
*G03G 15/08* (2006.01)
*G03G 21/00* (2006.01)

(52) U.S. Cl. ..... 399/106; 399/102

(58) Field of Classification Search ..... 399/102, 399/103, 105, 106
See application file for complete search history.

(56) References Cited

U.S. PATENT DOCUMENTS

| | | | | |
|---|---|---|---|---|
| 4,981,218 | A | 1/1991 | Ban | |
| 5,080,745 | A | 1/1992 | Paull | |
| 5,184,182 | A | 2/1993 | Michlin | |
| 5,282,003 | A | 1/1994 | Michlin | |
| 5,296,902 | A | 3/1994 | Michlin | |
| 5,337,126 | A | 8/1994 | Michlin | |
| 5,523,828 | A | 6/1996 | De Kesel | |
| RE35,529 | E | 6/1997 | Michlin | |
| 5,799,712 | A | 9/1998 | Kelly | |
| 5,876,541 | A | 3/1999 | Chitouras | |
| 5,878,306 | A * | 3/1999 | Michlin | 399/106 |
| 5,930,559 | A | 7/1999 | De Kesel | |
| 6,009,287 | A | 12/1999 | Goldie | |
| 6,014,534 | A | 1/2000 | Goebel | |
| 6,041,202 | A | 3/2000 | Cornelius | |
| 6,044,238 | A | 3/2000 | Rodriguez | |
| 6,118,958 | A | 9/2000 | Nagashima | |
| RE36,920 | E | 10/2000 | De Kesel | |
| 6,284,401 | B1 * | 9/2001 | Marchetti | 429/442 |
| 6,350,503 | B1 | 2/2002 | Cheatham | |
| 6,484,000 | B1 | 11/2002 | Ogawa | |

(Continued)

FOREIGN PATENT DOCUMENTS

| | | |
|---|---|---|
| EP | 0840182 | 5/1998 |

(Continued)

*Primary Examiner* — David M Gray
*Assistant Examiner* — Fred Braun

(57) ABSTRACT

A toner hopper seal assembly is disclosed. The toner hopper seal assembly has a gasket which has a gasket opening, a pull strip having a first and second end, the pull strip attached to a first side of the gasket and covering the gasket opening. The first end of the pull strip is positioned near the gasket opening. The toner hopper seal assembly also having an integrated pull tab disposed at an end of the gasket, the integrated pull tab has a first side and a second side, the integrated pull tab is formed from a same material as the gasket and separated from the gasket by a cut in the material. The toner hopper seal assembly also has an adhesive layer covering a second side of the gasket and the second side of the integrated pull tab as well as a release liner covering the adhesive layer on the second side of the gasket and the second side of the integrated pull tab. The release liner secures the integrated pull tab in place adjacent to the end of the gasket. Also disclosed is a method of affixing the toner hopper seal assembly to a toner cartridge.

18 Claims, 8 Drawing Sheets

U.S. PATENT DOCUMENTS

| | | | |
|---|---|---|---|
| 6,539,187 | B2 | 3/2003 | De Kesel |
| 6,552,780 | B1 | 4/2003 | Michlin |
| 6,560,422 | B2 | 5/2003 | Kanno |
| 6,596,110 | B1 | 7/2003 | Chitouras |
| 6,654,576 | B2 | 11/2003 | Dougherty |
| 6,687,475 | B2 | 2/2004 | Kacinski |
| 6,754,460 | B2 | 6/2004 | Lewis |
| 6,760,556 | B2 | 7/2004 | De Kesel |
| 6,775,493 | B2 | 8/2004 | De Kesel |
| 6,778,793 | B2 | 8/2004 | De Kesel |
| 6,782,220 | B2 | 8/2004 | De Kesel |
| 6,842,595 | B1 | 1/2005 | McIver |
| 6,925,273 | B1 | 8/2005 | Michlin |
| 7,197,260 | B2 | 3/2007 | Jones |
| 2002/0012546 | A1 | 1/2002 | Chanadi |
| 2002/0127024 | A1 | 9/2002 | Matsumoto |
| 2003/0170045 | A1 | 9/2003 | Lewis |
| 2004/0141768 | A1 | 7/2004 | Daniels |

FOREIGN PATENT DOCUMENTS

| | | |
|---|---|---|
| GB | 2321219 | 7/1998 |
| JP | 7028323 | 1/1995 |
| JP | 2004126142 | 4/2004 |

* cited by examiner

UNIVERSAL CARTRIDGE SEAL AND METHOD FOR FIXING THE SEAL TO A CARTRIDGE

FIELD OF INVENTION

The present invention relates to remanufacturing of imaging process cartridges, such as printer toner cartridges, and more particularly to a universal cartridge seal for use in a remanufactured imaging process cartridge.

BACKGROUND

Printer cartridges are typically designed to provide the consumer a certain number of print copies before the toner or ink is exhausted. The total number of prints varies depending on the type, quality and density of the print provided by the printer. After all of the toner or ink is spent, the cartridges are either thrown away or recycled.

An emerging industry has developed that deals with the recycling of printer cartridges. Typically, the OEM (Original Equipment Manufactured) cartridge is recycled by a cartridge remanufacturer, who receives spent printer cartridges and refurbishes them. The toner cartridge remanufacturing process typically entails disassembling, cleaning, refurbishing and reassembling the cartridge.

A typical OEM toner cartridge consists of an assembled plastic housing which may have several sections. During the remanufacturing process, the different sections of the toner cartridge may be separated allowing the remanufacturer to access the various internal components that may need to be replaced. Some exemplary components that may need to be replaced include but are not limited to a developer roller, fuser wand, wiper blades, OPC (organic photo conductor) drum and the like. After the components are replaced, a seal may be placed over a toner reservoir prior to reassembling the toner cartridge. After toner is placed into the reassembled toner cartridge, the seal keeps the toner from escaping the toner reservoir during the shipment of the toner cartridge. The seal may be broken by the end consumer prior to placing the toner cartridge into the printer. Breaking the seal allows toner to leave the toner reservoir and be presented to the various components within the toner cartridge. As part of the printing process, toner is transferred from the toner reservoir to the developer roller, onto the OPC drum, onto the print media and is melted onto the media.

Commonly, seals currently used by OEM toner cartridge manufacturers and toner cartridge remanufacturers may be comprised of separate items that have to be assembled. Typically, these seals may pull strips that extend away from the toner cartridge and include a separate pull tab. The pull tab allows the consumer greater leverage when pulling the pull strip thus breaking the seal. However, it may be advantageous to have a unitarily constructed seal that includes an integrated pull tab.

SUMMARY

The present disclosure recognizes this need and discloses a unitarily constructed toner hopper seal assembly having an integrated pull tab. The toner hopper seal assembly has a gasket which has a gasket opening, a pull strip having a first and second end, the pull strip attached to a first side of the gasket and covering the gasket opening. The first end of the pull strip is positioned near the gasket opening. The toner hopper seal assembly also having an integrated pull tab disposed at an end of the gasket, the integrated pull tab has a first side and a second side, the integrated pull tab is formed from a same material as the gasket and separated from the gasket by a cut in the material. The toner hopper seal assembly also has an adhesive layer covering a second side of the gasket and the second side of the integrated pull tab as well as a release liner covering the adhesive layer on the second side of the gasket and the second side of the integrated pull tab. The release liner secures the integrated pull tab in place adjacent to the end of the gasket.

A remanufactured toner cartridge is disclosed. The remanufactured toner cartridge has a toner hopper assembly connected to a waste bin assembly; the toner hopper assembly also has a toner hopper reservoir which has an opening. Attached to the toner hopper assembly is a toner hopper seal assembly. The toner hopper seal assembly has a gasket which has a gasket opening, a pull strip which has a first and second end, the pull strip attached to a first side of the gasket and covering the gasket opening, the first end of the pull strip positioned near the gasket opening. The toner hopper seal assembly also has a integrated pull tab disposed at an end of the gasket, the integrated pull tab has a first side and a second side, the integrated pull tab is formed from a same material as the gasket and is separated from the gasket by a cut in the material. The toner hopper seal assembly also has an adhesive layer covering a second side of the gasket and the second side of the integrated pull tab as well as a removable film covering the adhesive layer on the second side of the gasket and the second side of the integrated pull tab. The removable film secures the integrated pull tab in place adjacent to the end of the gasket.

A method of affixing a toner hopper seal assembly to a toner cartridge is disclosed. The method provides the toner cartridge, the toner cartridge having a toner hopper assembly and a waste bin assembly, the toner hopper assembly having an opening above a toner hopper reservoir. The method separates the toner hopper assembly from the waste bin assembly. The method further affixes a toner hopper seal assembly over the opening of the toner hopper reservoir. The toner hopper seal assembly has a gasket which has a gasket opening, a pull strip which has a first and second end, the pull strip attached to a first side of the gasket and covering the gasket opening, the first end of the pull strip positioned near the gasket opening. The toner hopper seal assembly also has a integrated pull tab disposed at an end of the gasket, the integrated pull tab has a first side and a second side, the integrated pull tab is formed from a same material as the gasket and is separated from the gasket by a cut in the material. The toner hopper seal assembly also has an adhesive layer covering a second side of the gasket and the second side of the integrated pull tab as well as a removable film covering the adhesive layer on the second side of the gasket and the second side of the integrated pull tab. The removable film secures the integrated pull tab in place adjacent to the end of the gasket.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings, which illustrate specific embodiments of the invention. In the discussion that follows, specific systems and techniques for repairing, manufacturing or remanufacturing an imaging cartridge, such as a toner cartridge are used as examples. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

In the toner cartridge refurbishment industry, the used toner cartridges are collected and serviced by toner cartridge remanufacturers. The first step in the refurbishment process is the disassembling of the spent cartridges. Next, the internal components are separated. Non-functioning components are replaced, and the remaining components, as well as the body of the device undergo a cleaning process. In the final step the device is reassembled and new toner is added to the toner cartridge. The refurbished device is then packaged and distributed to the consumer.

Figure 1:
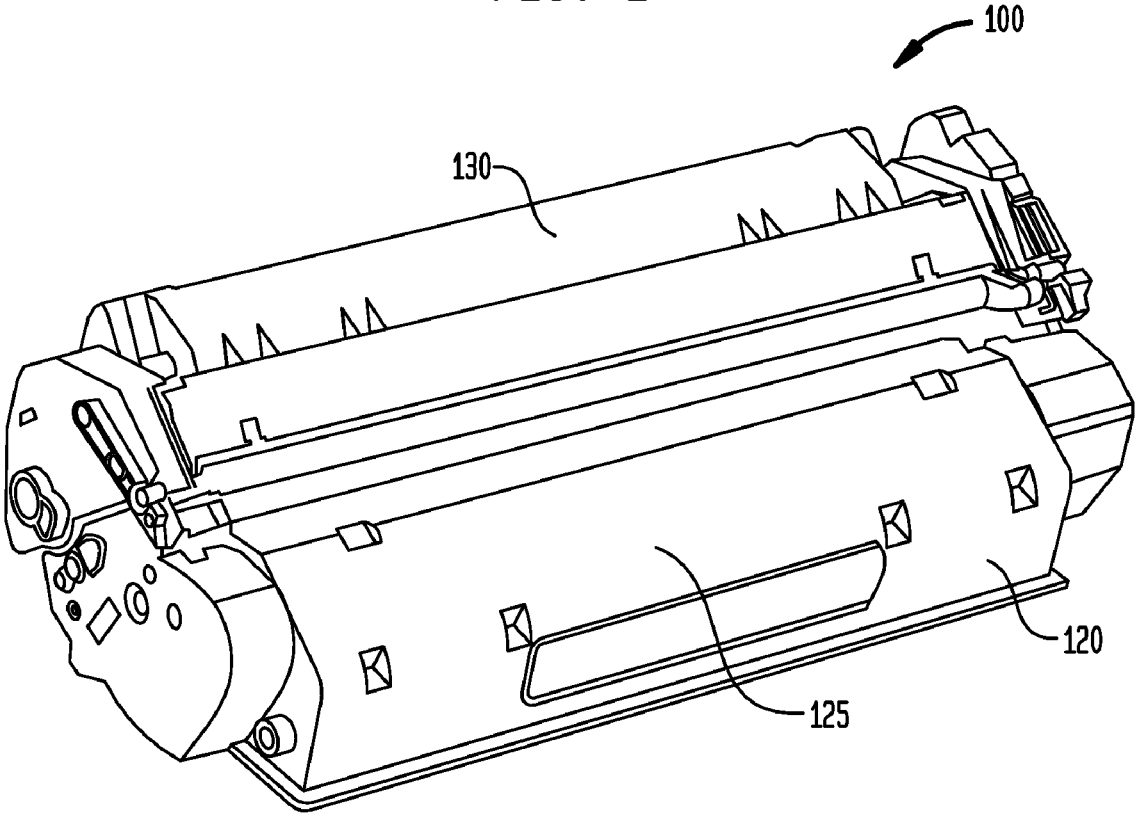
FIG. 1 shows a view of a fully assembled HP1200 toner cartridge.

The inventive concepts of the present invention are more clearly understood in reference to the toner cartridge 100 displayed in FIG. 1. The toner cartridge 100 may be used in an HP1200 family of printers. Toner cartridge 100 has two main sections, a toner hopper assembly 120 and a waste bin assembly 130. Within the toner hopper assembly 120 is a toner reservoir 125 for storing toner used during the printing process. In the toner cartridge 100 and more specifically in between the toner hopper assembly 120 and the waste bin assembly 130 are various components (not shown for ease of illustration) such as the developer roller, OPC drum, transfer roller, wiper blade, and the like.

Figure 2:
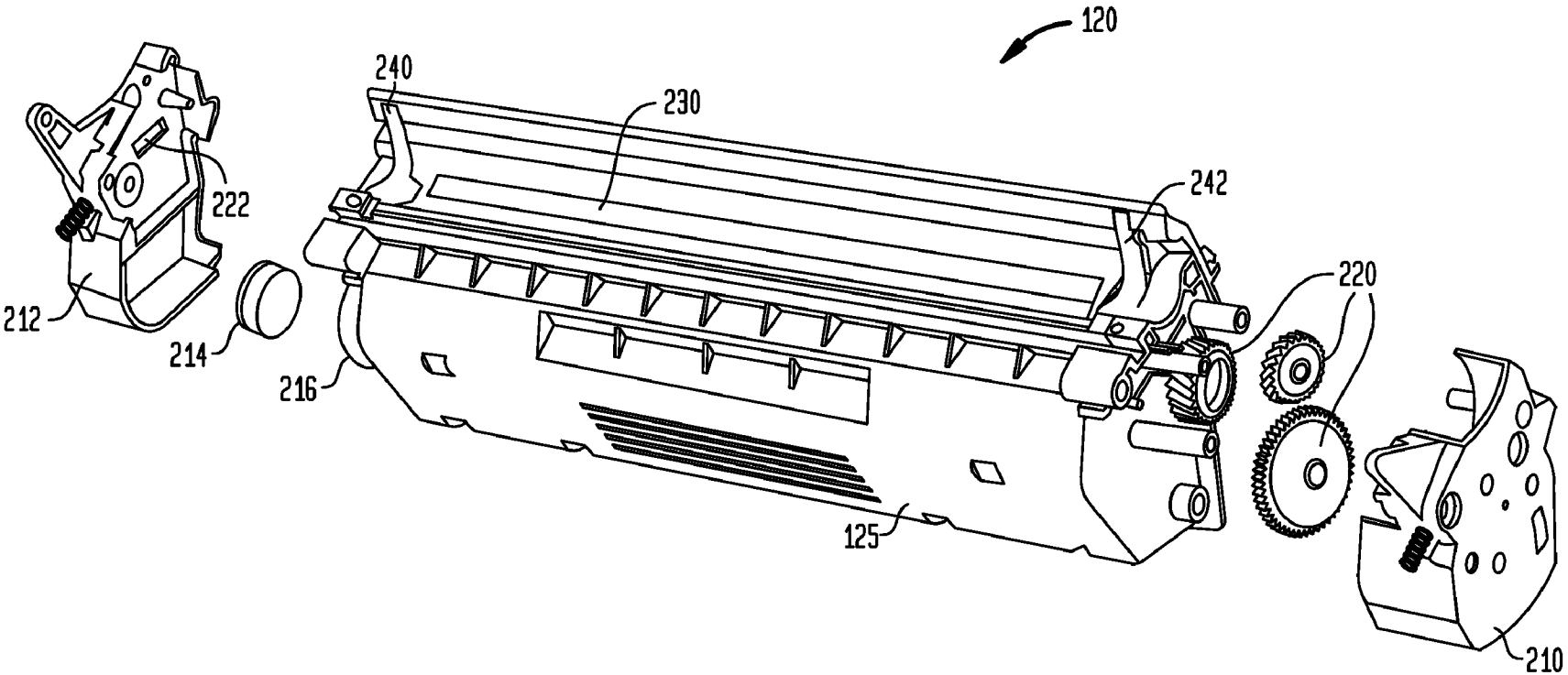
FIG. 2 shows an exploded view of a toner hopper assembly of the HP1200 laser toner cartridge with the waste bin assembly removed.

FIG. 2 displays an exploded view of the toner hopper assembly 120, after the waste bin assembly 130 has been removed. On top of the toner hopper reservoir 125 is a left and a right developer roller guide 240 and 242, respectively, which assist in positioning a developer roller (not shown for ease of illustration) in front of an opening 230 in the toner hopper reservoir 125. During the printing process toner is presented to the developer roller as it rotates in front of the opening 230. Toner is then transferred from the developer roller to an OPC drum (not shown) which may contain a latent image that may be etched by a laser in the printer. As the OPC drum rotates in front of the developer roller, the latent image may attract the toner off of the developer roller. As the OPC drum rotates, the toner on the OPC drum may in turn be transferred to the print media.

As displayed in FIG. 2, the toner hopper assembly 120 has a right end cap 210 and a left end cap 212. When the right end cap 210 is separated from the toner hopper assembly 120, gears 220 are exposed. The gears 220 are used to rotate the various components within the toner cartridge 100. Located on the left end cap 212 is a pull strip opening 222. When the left end cap 212 is removed, the toner fill cap 214 is exposed. The toner fill cap 214 is positioned over a toner fill opening 216 and may be removed by the remanufacturer to aid in cleaning any remaining residual toner left in the toner reservoir 125. After the waste bin 130 has been removed and during the cleaning process of the toner cartridge 100, any residual toner may be removed from the toner reservoir 125 by introducing compressed air through the toner fill opening 216. The compressed air may express the residual toner out the opening 230 in the toner reservoir 125.

Typically, a gasket of a prior seal assembly (not shown) may be in place around the opening 230. The gasket of the prior seal assembly may be from an OEM seal assembly if the cartridge has not been previously refurbished. Alternatively, the gasket may be from a non-OEM seal assembly installed by a remanufacturer. In order to refurbish the toner cartridge 100, the old gasket is removed. This step may take place after the toner hopper 120 is separated from the waste bin assembly 130 and the developer roller is removed. Once the old gasket is removed, a new seal may be installed over the opening 230. Similar to the old seal, the new seal is used to keep toner confined within the toner reservoir 125 during shipment of the refurbished toner cartridge 100 to the end user. After the end user receives the toner cartridge 100, and prior to installing the toner cartridge 100 into the printer, the end user may break the seal by pulling on a pull strip attached to the gasket of the new seal. Pulling the pull strip breaks the integrity of the seal and allows toner to flow from the toner reservoir 125 to the developer roller.

Figure 3:
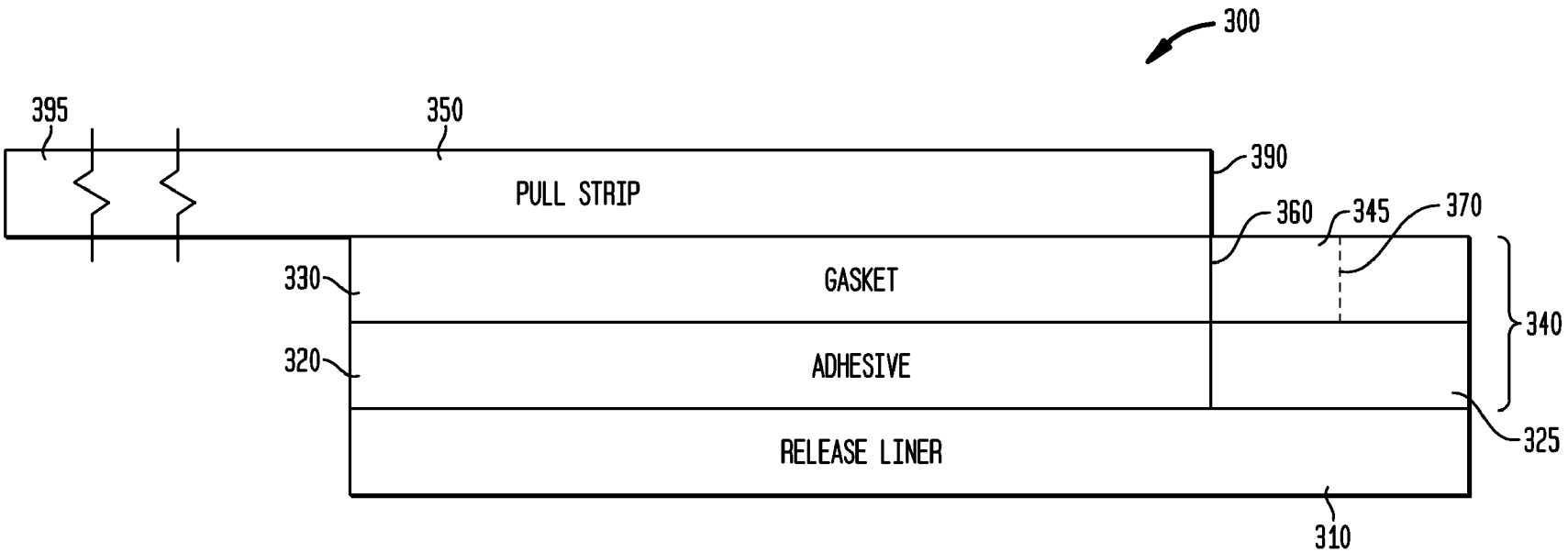
FIG. 3 shows a cross sectional view of a toner hopper seal in accordance with one embodiment of the present invention.

A cross sectional view of a toner hopper seal assembly 300 in accordance with one embodiment of the present is shown in FIG. 3. The toner hopper seal assembly 300 has a release liner 310 which extends across adhesive layers 320 and 325. The adhesive layer 320 is positioned below a gasket 330. Above the gasket 330 is a pull strip 350. The pull strip has a first end 390 and a second end 395. Positioned next to the gasket 330 and the adhesive layer 320 is an integrated pull tab 340. The integrated pull tab 340 has a tab portion 345 positioned above the adhesive layer 325. In one exemplary embodiment, the tab portion 345 is constructed of the same material as the gasket 330. In another embodiment, the adhesive layer 320 uses the same adhesive as the adhesive layer 325 of the integrated pull tab 340.

In one embodiment, the gasket 330 may be made of polycarbonate material. In an alternative embodiment, the gasket 330 may be formed from high impact polystyrene. In yet another embodiment, the gasket 330 may be manufactured from a PVC (poly vinyl chloride) material. Gaskets made from these materials may be flexible enough to be positioned into place on the toner hopper assembly 120. Alternatively, the gasket 330 may be formed from relatively stiff materials. In addition, the pull strip 350 may be made of an aluminum film coated with polyester. In yet another embodiment, the pull strip may be made of a clear plastic polyester film. The polyester film may provide additional strength to the pull strip 350 keeping it from separating when pulled. Similar to the adhesive layers 320 and 325, the pull strip 350 may also have an adhesive (not shown for ease of illustration) to keep the pull strip 350 attached to the gasket 330. In one embodiment, the pull strip adhesive may be heat activated. Alternatively, the pull strip 350 may be a ribbon material that is bonded to the gasket 330 with an adhesive material.

In the embodiment as shown in FIG. 3, the integrated pull tab 340 is separated from the gasket 330 and the adhesive layer 320 by a cut 360 which extends through the gasket 330 and adhesive layer 320 but not through the release liner 310. Within the tab portion 345 is a perforation 370. In one embodiment, the perforation 370 is positioned in the center of the tab portion 345. As is explained in greater detail in subsequent paragraphs, the integrated pull tab 340 may be folded in half along the perforation 370.

Figure 4A:
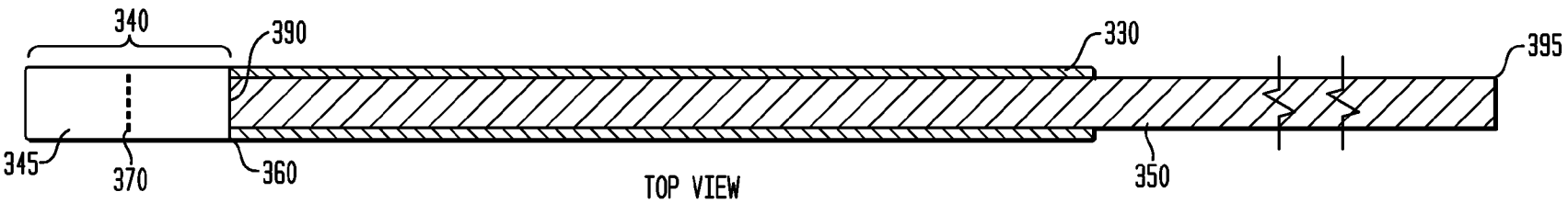
FIG. 4A shows a top view of the toner hopper seal of FIG. 3.
Figure 4B:
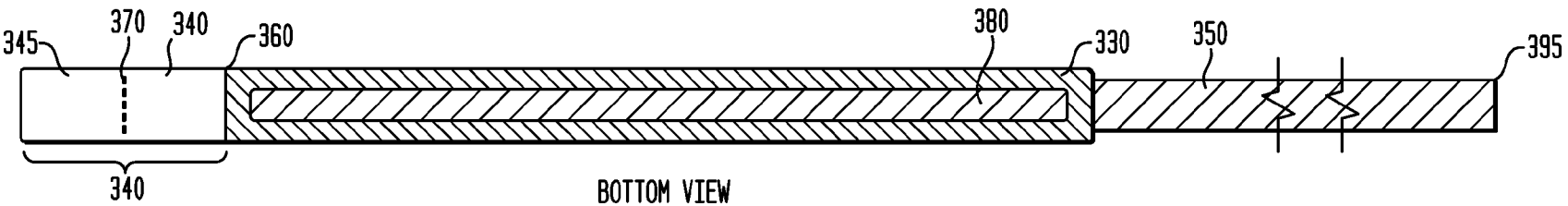
FIG. 4B shows a bottom view of the toner hopper seal of FIG. 3.

FIGS. 4A and 4B display a top view and a bottom view of the toner hopper seal assembly 300 respectively. For clarity purposes, the release liner 310 and adhesive layers 320 and 325 are shown as being transparent to allow the gasket 330 and pull strip 350 to be visible. When the release liner 310 is removed, the toner hopper seal assembly 300 may be attached to the edges the opening 230 of the toner cartridge 100 (FIG. 2). In one embodiment, the gasket 330 does not protrude into the opening 230. If the gasket 330 were to extend into the opening 230, toner may accumulate against the adhesive layer 320.

As is displayed in FIG. 4A, the first end 390 of the pull strip 350 may be disposed at or near the cut 360. In another embodiment, the first end 390 is positioned at or near the edge of the gasket opening 380. It may be preferable to locate the first end 390 in between the cut 360 and the gasket opening 380.

Referring to FIG. 4B, the pull strip 350 is positioned over a gasket opening 380. When the toner hopper seal assembly 300 is installed over the opening 230, the toner hopper seal assembly 300 prevents toner from escaping the toner hopper reservoir 125. However, when the toner cartridge 100 is to be inserted into a printer, the pull strip 350 is removed, allowing toner to flow from the toner hopper reservoir 125 through the gasket opening 380 and to the developer roller.

In an exemplary embodiment, when the release liner 310 is removed from the adhesive layer 320, the integrated pull tab 340 may also be pulled away from the gasket 330. In this embodiment, the integrated pull tab 340, still affixed to the release liner 310, may be set aside while the toner hopper seal assembly 300 is placed into position over the opening 230 of the toner cartridge 100. As is explained in the discussion of FIGS. 6A-6B, the integrated pull tab 340 may be affixed to the second end 395 of the pull strip 350.

Figure 5A:
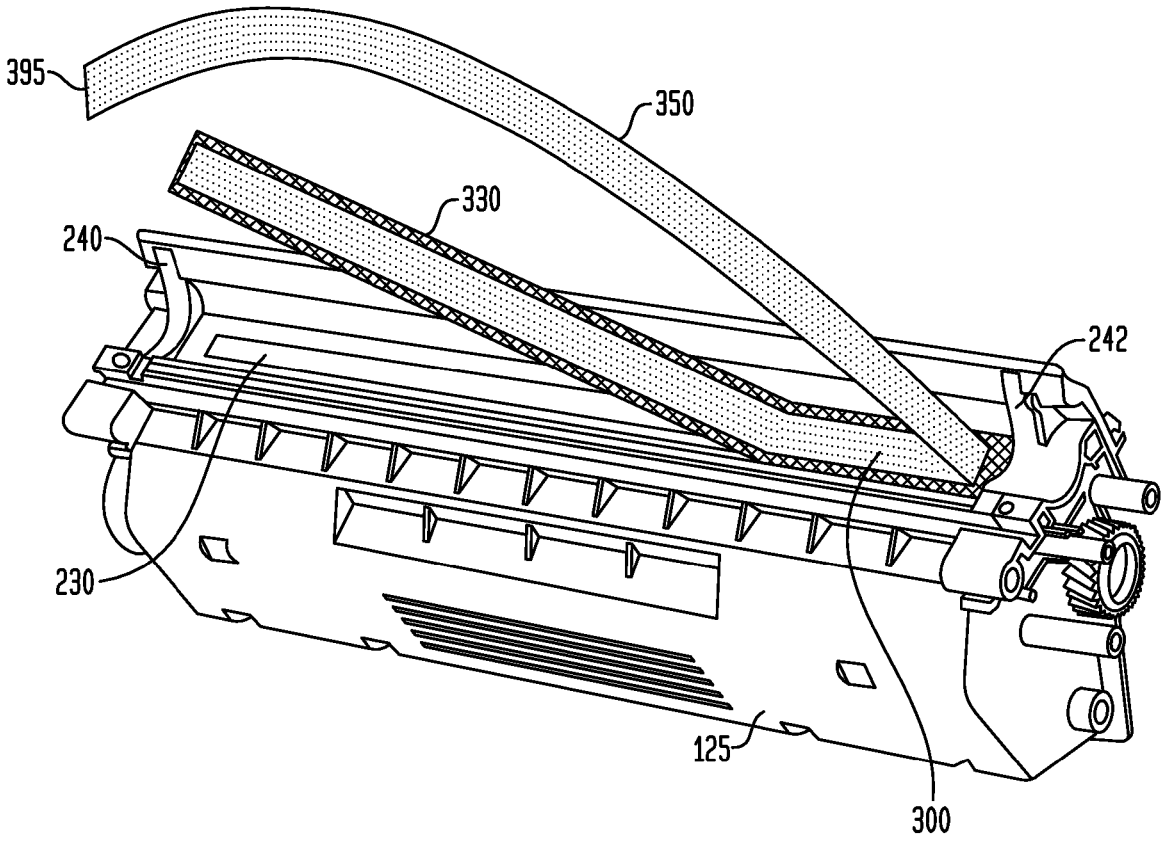
FIG. 5A displays the toner hopper seal of FIGS. 3-4 partially installed on to the toner hopper in accordance with one embodiment of the present invention.

FIG. 5A displays the toner hopper seal assembly 300 as it is partially installed on a toner hopper assembly 120. As depicted in FIG. 5A, the release liner 310 has been removed, exposing the adhesive layer 320. When the toner hopper seal assembly 300 is positioned over the opening 230, downward pressure is exerted against the top of the gasket 330. The downward pressure may be applied to the top of the gasket 330 starting at the first end 390 of the pull strip 350 and applied uniformly across the length of the gasket 330.

Figure 5B:
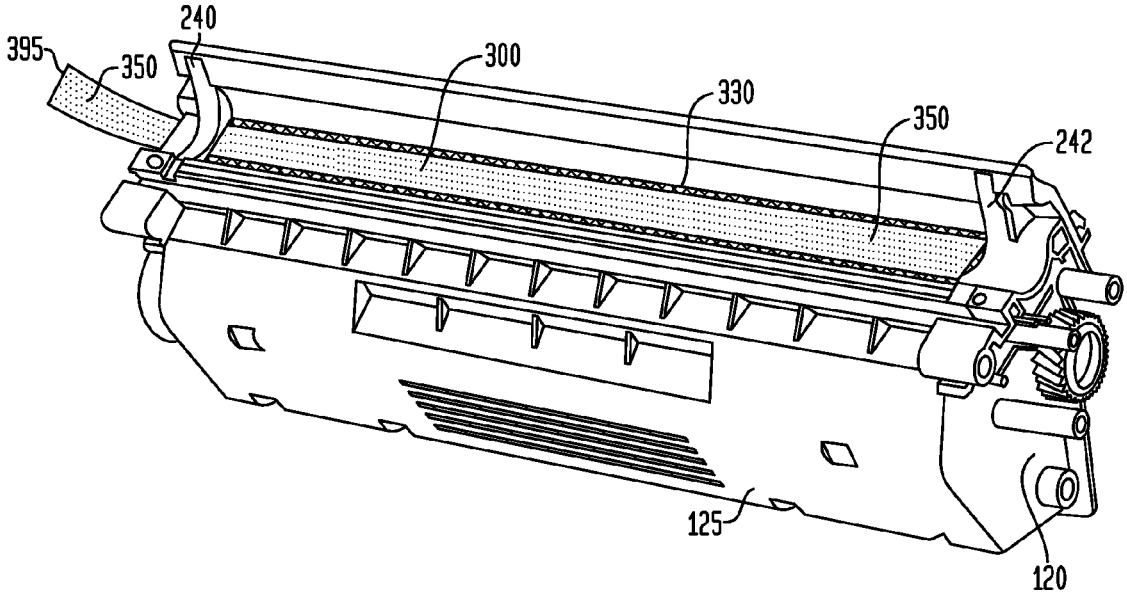
FIG. 5B displays the toner hopper seal of FIGS. 3-4 installed on to the toner hopper.

FIG. 5B displays the toner hopper seal assembly 300 completely installed over the opening 230 of the toner reservoir 125. After the toner hopper seal assembly 300 has been affixed into place, the second end 395 of the pull strip 350 is routed through a gap that exists under the left developer roller guide 240. After the second end 395 of the pull strip 350 has been routed through the gap, a predetermined amount of toner may be poured into the toner fill opening 216. Once the toner reservoir 125 has been filled with toner, the toner fill cap 214 is secured into the toner fill opening 216 and the left end plate 212 may be reattached to the toner hopper assembly 120. Prior to the left end plate 212 being reattached to the toner hopper assembly 120, the second end 395 of the pull strip 350 is routed through the pull strip opening 222 (FIG. 2).

Figure 6A:
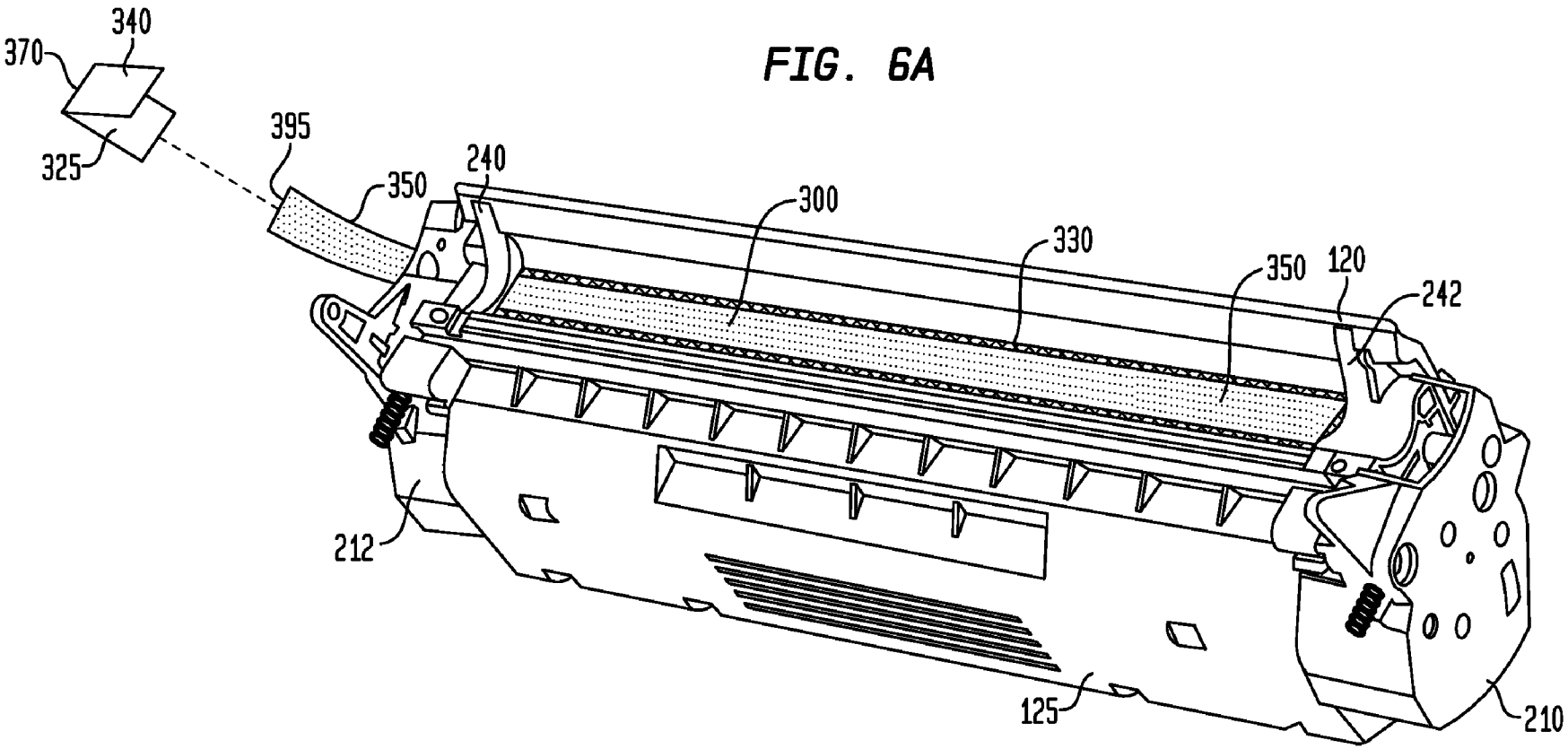
FIG. 6A shows front perspective view of the toner hopper with a toner hopper seal installed and an integrated pull exploded away from a pull strip.
Figure 6B:
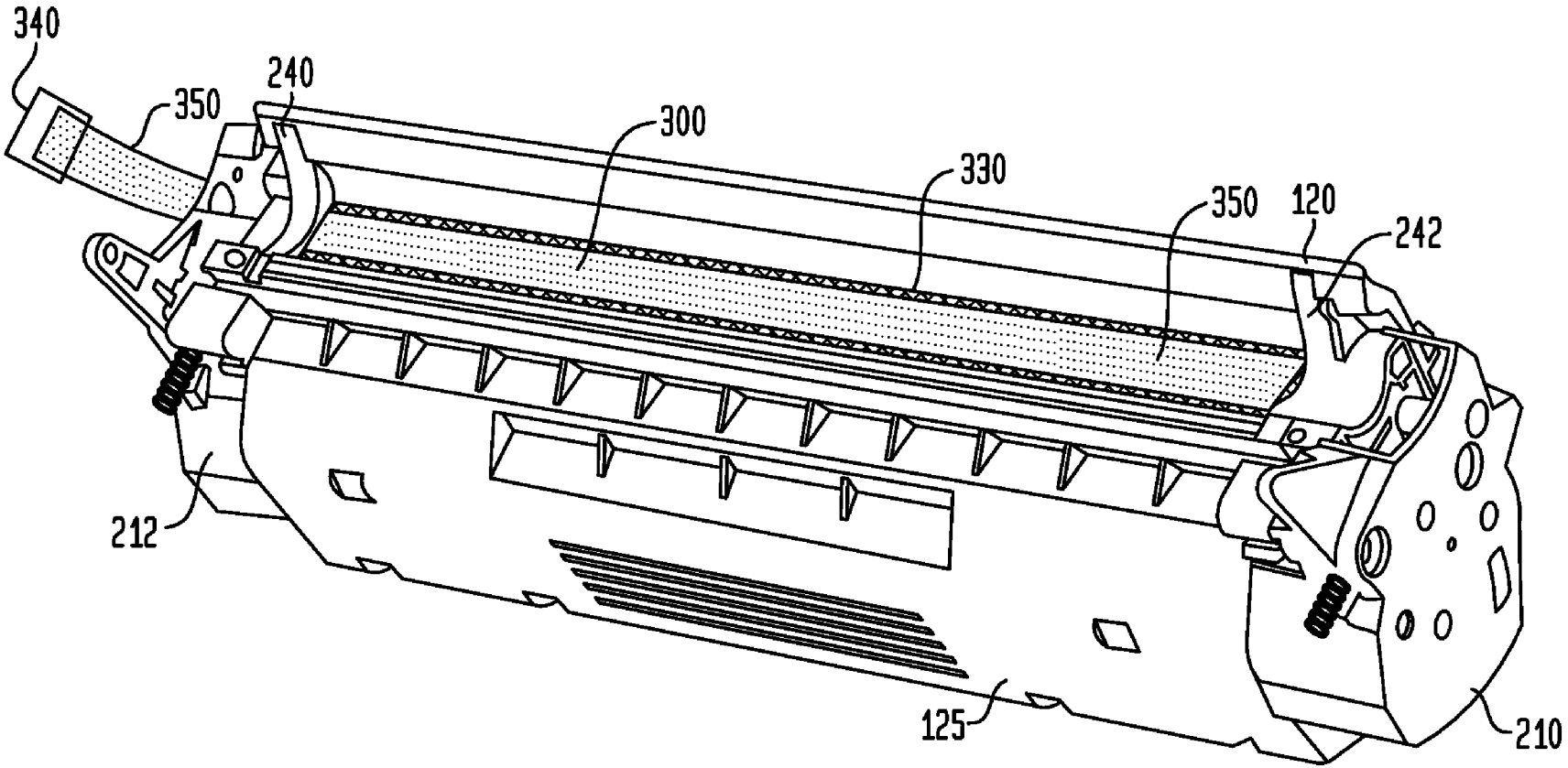
FIG. 6B shows front perspective view of the toner hopper with a toner hopper seal installed and the integrated pull installed on the pull strip in accordance with an embodiment of the present invention.

FIG. 6A displays a toner hopper assembly 120 that has a toner hopper seal assembly 300 affixed into place and the right and left end caps 210 and 212 respectively have been secured back onto the toner hopper assembly 120. As shown exploded away from the second end 395 of the pull strip 350, the integrated pull tab 340 may be folded in half along the perforation 370 such that the two halves of the adhesive layer 325 are facing each other. The integrated pull tab 340 may in turn be attached to the second end 395 of the pull strip 350 as shown in FIG. 6B. Once attached, the integrated pull tab 340 may allow the consumer a larger surface to grab when the consumer chooses to remove the pull strip 350 and break the integrity of the toner hopper seal assembly 300, thus allowing toner to flow to the developer roller.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A toner hopper seal assembly comprising:

a gasket having a gasket opening;

a pull strip having a first and second end, the pull strip attached to a first side of the gasket and covering the gasket opening, the first end of the pull strip positioned near the gasket opening;

an integrated pull tab disposed at an end of the gasket, the integrated pull tab having a first side and a second side, the integrated pull tab formed from a same material as the gasket and separated from the gasket by a cut in the material, wherein the integrated pull tab includes a perforation disposed parallel to the cut and equidistant to a first and second ends of the integrated pull tab;

an adhesive layer covering a second side of the gasket and the second side of the integrated pull tab; and a release liner covering the adhesive layer on the second side of the gasket and the second side of the integrated pull tab, the release liner securing the integrated pull tab in place adjacent to the end of the gasket.

2. The toner hopper seal assembly of claim 1 wherein the integrated pull tab may be folded in half along the perforation and attached to the second end of the pull strip.

3. The toner hopper seal assembly of claim 1 wherein the pull strip is comprised of an aluminum film coated with polyester.

4. The toner hopper seal assembly of claim 1 wherein the pull strip is comprised of a clear plastic polyester film.

5. The toner hopper seal assembly of claim 1 wherein the gasket is composed of a polycarbonate material.

6. The toner hopper seal assembly of claim 1 wherein a heat activated adhesive is used to affix the pull strip to the gasket.

7. A remanufactured toner cartridge comprising:

a toner hopper assembly connected to a waste bin assembly, the toner hopper assembly further comprising a toner hopper reservoir, the toner hopper reservoir having an opening, and;

a toner hopper seal assembly, the toner hopper seal assembly further comprising a gasket having a gasket opening;

a pull strip having a first and second end, the pull strip attached to a first side of the gasket and covering the gasket opening, the first end of the pull strip positioned near the gasket opening;

an integrated pull tab disposed at an end of the gasket, the integrated pull tab having a first side and a second side, the integrated pull tab formed from a same material as the gasket and separated from the gasket by a cut in the material, wherein the integrated pull tab includes a perforation disposed parallel to the cut and equidistant to a first and second ends of the integrated pull tab;

an adhesive layer covering a second side of the gasket and the second side of the integrated pull tab; and a removable film covering the adhesive layer on the second side of the gasket and the second side of the integrated pull tab, the removable film covering securing the integrated pull tab in place adjacent to the end of the gasket.

8. The remanufactured toner cartridge of claim 7 wherein the integrated pull tab may be folded in half along the perforation and attached to the second end of the pull strip.

9. The remanufactured toner cartridge of claim 7 wherein the pull strip is comprised of an aluminum film coated with polyester.

10. The remanufactured toner cartridge of claim 7 wherein the pull strip is comprised of a clear plastic polyester film.

11. The remanufactured toner cartridge of claim 7 wherein the gasket is composed of a polycarbonate material.

12. The remanufactured toner cartridge of claim 7 wherein a heat activated adhesive is used to affix the pull strip to the gasket.

13. A method of affixing a toner hopper seal assembly to a toner cartridge comprising:

providing the toner cartridge, the toner cartridge having a toner hopper assembly and a waste bin assembly, the toner hopper assembly having an opening above a toner hopper reservoir, separating the toner hopper assembly from the waste bin assembly, affixing a toner hopper seal assembly over the opening of the toner hopper reservoir, the toner hopper seal assembly having a gasket having a gasket opening;

a pull strip having a first and second end, the pull strip attached to a first side of the gasket and covering the gasket opening, the first end of the pull strip positioned near the gasket opening;

an integrated pull tab disposed at an end of the gasket, the integrated pull tab having a first side and a second side, the integrated pull tab formed from a same material as the gasket and separated from the gasket by a cut in the material, wherein the integrated pull tab includes a perforation disposed parallel to the cut and equidistant to a first and second ends of the integrated pull tab;

an adhesive layer covering a second side of the gasket and the second side of the integrated pull tab; and a removable film covering the adhesive layer on the second side of the gasket and the second side of the integrated pull tab, the removable film securing the integrated pull tab in place adjacent to the end of the gasket.

14. The method of claim 13 further comprising:

attaching the integrated pull tab to the second end of the pull strip.

15. The method of claim 13 wherein the pull strip is comprised of an aluminum film coated with polyester.

16. The method of claim 13 wherein the pull strip is comprised of a clear plastic polyester film.

17. The method of claim 13 wherein the gasket is composed of a polycarbonate material.

18. The method of claim 13 wherein a heat activated adhesive is used to affix the pull strip to the gasket.

* * * * *